US007378026B1

(12) United States Patent
Thompson

(10) Patent No.: US 7,378,026 B1
(45) Date of Patent: May 27, 2008

(54) DRILL MOTOR OPERATED PORTABLE WATER-TOLERANT SUCTION CLEANER

(76) Inventor: Bruce A. Thompson, 6700 Auburn Folsom Rd., Granite Bay, CA (US) 95746

( * ) Notice: Subject to any disclaimer, the term of this patent is extended or adjusted under 35 U.S.C. 154(b) by 408 days.

(21) Appl. No.: 11/311,832

(22) Filed: Dec. 19, 2005

Related U.S. Application Data

(60) Provisional application No. 60/646,179, filed on Jan. 24, 2005.

(51) Int. Cl.
*B01D 35/02* (2006.01)
*E04H 4/16* (2006.01)

(52) U.S. Cl. ..... 210/767; 210/167.16; 210/170.2; 210/416.1; 210/416.2

(58) Field of Classification Search ..... None
See application file for complete search history.

(56) References Cited

U.S. PATENT DOCUMENTS 1,516,359 A * 11/1924 Tideman ..... 137/577.5
1,966,325 A * 7/1934 Welch ..... 415/72
2,045,757 A * 6/1936 Constantin ..... 198/659
2,438,637 A * 3/1948 Jansen ..... 37/189
2,473,066 A * 6/1949 Miller ..... 55/368
2,765,275 A * 10/1956 Aaron ..... 210/167.25
2,828,019 A * 3/1958 Lambertson ..... 210/167.21
2,956,507 A * 10/1960 Hutchinson ..... 417/478
3,158,104 A * 11/1964 Hutchinson ..... 210/416.2
3,225,930 A * 12/1965 Willinger ..... 210/241
3,258,801 A * 7/1966 Campbell ..... 15/1.7
3,360,129 A * 12/1967 Powers ..... 210/167.23
D214,918 S * 8/1969 Willinger ..... D30/106
3,549,015 A * 12/1970 Willinger ..... 210/416.2
3,630,364 A * 12/1971 Johnston ..... 210/167.23
3,734,853 A * 5/1973 Horvath ..... 210/167.25
3,755,843 A * 9/1973 Goertzen et al. ..... 15/1.7
3,774,613 A * 11/1973 Woods et al. ..... 604/128
3,791,524 A * 2/1974 Cho ..... 210/232
3,814,254 A * 6/1974 Schatz ..... 210/167.23
3,820,182 A * 6/1974 Vockroth ..... 15/1.7
3,826,371 A * 7/1974 Adamson ..... 210/167.21
3,924,625 A * 12/1975 Peterson ..... 604/131
3,965,608 A * 6/1976 Schuman ..... 43/110
4,094,031 A * 6/1978 Cellini ..... 15/1.7
4,094,788 A * 6/1978 Dockery ..... 210/167.21
4,233,702 A * 11/1980 Zweifel ..... 15/1.7
4,253,691 A * 3/1981 Liu ..... 294/1.4
4,286,816 A * 9/1981 Tobias ..... 294/1.4
4,290,883 A * 9/1981 Sama ..... 210/167.23
4,338,697 A * 7/1982 Broadwater ..... 15/1.7
4,372,700 A * 2/1983 Moffitt, Jr. ..... 401/157
D282,016 S * 12/1985 Chestnut ..... D30/106
4,584,733 A * 4/1986 Tietge et al. ..... 15/1.7
4,610,784 A * 9/1986 Reyniers ..... 210/167.23
4,722,670 A * 2/1988 Zweifel ..... 417/181
4,797,206 A * 1/1989 Lynch ..... 210/167.16

(Continued)

*Primary Examiner*—Robert James Popovics

(57) ABSTRACT

The present invention describes an apparatus and teaches a method for removing particulate matter from a plurality of vessels. Examples of these vessels include aquariums, spas, fountains and pools. An ordinary hand held power drill motor is connected via a drill motor pump to a pick-up head containing a pair of hoses. Upon activation, a first hose applies suction to the pick-up head drawing both water and particulate into a chamber. The water continues through to a pump mounted in a housing, through the pump and out the discharge hose while the particulate is trapped within the chamber by a filter for later removal.

6 Claims, 5 Drawing Sheets

U.S. PATENT DOCUMENTS 4,807,318 A * 2/1989 Kallenbach ..... 15/1.7
4,870,975 A * 10/1989 Cronk et al. ..... 600/562
D304,506 S * 11/1989 Tominaga ..... D30/106
4,896,392 A * 1/1990 Hull et al. ..... 15/1.7
4,935,980 A * 6/1990 Leginus et al. ..... 15/1.7
4,944,101 A * 7/1990 Goble ..... 15/1.7
4,957,492 A * 9/1990 Shizuo et al. ..... 604/319
4,962,559 A * 10/1990 Schuman ..... 15/1.7
5,095,571 A * 3/1992 Sargent ..... 15/1.7
5,122,285 A * 6/1992 Tartal ..... 210/787
RE34,031 E * 8/1992 Thomsen et al. ..... 210/232
5,135,647 A * 8/1992 Childers ..... 210/136
5,238,585 A * 8/1993 Reed, Sr. ..... 210/805
5,240,596 A * 8/1993 Chesnut ..... 210/136
5,279,730 A * 1/1994 Chen ..... 210/167.23
5,317,776 A * 6/1994 DeMoura ..... 15/1.7
5,318,701 A * 6/1994 Wang ..... 210/167.21
5,336,122 A * 8/1994 Lewis ..... 446/153
5,542,142 A * 8/1996 Young ..... 15/1.7
5,624,418 A * 4/1997 Shepard ..... 604/319
5,634,229 A * 6/1997 Stoltz ..... 15/1.7
5,655,245 A * 8/1997 Bunch ..... 15/1.7
5,661,873 A * 9/1997 Karet ..... 15/344
5,695,654 A * 12/1997 Schultz ..... 210/780
5,975,022 A * 11/1999 Miller ..... 119/264
6,019,891 A * 2/2000 Stoner ..... 210/136
6,058,884 A * 5/2000 Rawls ..... 119/259
6,202,677 B1 * 3/2001 Chen et al. ..... 137/428
6,269,773 B1 * 8/2001 Rawls ..... 119/259
6,444,120 B1 * 9/2002 Morgan ..... 210/167.23
6,494,674 B1 * 12/2002 Cameron ..... 415/124.2
6,673,022 B1 * 1/2004 Bobo et al. ..... 600/561
6,749,614 B2 * 6/2004 Teitelbaum et al. ..... 606/61
6,797,157 B2 * 9/2004 Erlich ..... 210/94
6,813,810 B2 * 11/2004 Beynon ..... 15/406
6,878,267 B1 * 4/2005 Mandia ..... 210/167.21
6,880,873 B2 * 4/2005 Stoev ..... 294/1.4
6,899,713 B2 * 5/2005 Shaolian et al. ..... 606/61
6,939,460 B2 * 9/2005 Erlich ..... 210/94
7,001,510 B1 * 2/2006 Adame ..... 210/167.23
7,003,846 B2 * 2/2006 Holtz ..... 15/344
7,060,182 B2 * 6/2006 Erlich et al. ..... 210/167.16
7,178,188 B1 * 2/2007 Jaakola ..... 15/1.7
7,179,373 B1 * 2/2007 Wehmeyer et al. .... 210/167.23
7,214,314 B2 * 5/2007 Reyniers ..... 210/232
7,226,098 B1 * 6/2007 Moreira ..... 294/1.4
D556,396 S * 11/2007 Mah et al. ..... D32/18
2003/0101523 A1 * 6/2003 Lepley ..... 15/1.7
2003/0192143 A1 * 10/2003 Beynon ..... 15/304
2004/0006341 A1 * 1/2004 Shaolian et al. ..... 606/61
2004/0164033 A1 * 8/2004 Reyniers ..... 210/800
2004/0263008 A1 * 12/2004 Voigt et al. ..... 310/58
2006/0058826 A1 * 3/2006 Evans et al. ..... 606/170
2006/0064825 A1 * 3/2006 Reed ..... 15/1.7

* cited by examiner

DRILL MOTOR OPERATED PORTABLE WATER-TOLERANT SUCTION CLEANER

This non-provisional utility patent application claims the benefit of provisional application No. 60/646,179 filed Jan. 24, 2005.

BRIEF DESCRIPTION

The subject of this invention relates to the cleaning of large particulates from ponds, pools, aquariums and the like. More specifically, the disclosed invention teaches a novel portable, drill operated suction device that can be configured to clean large particulates from a number of small to medium sized vessels. The disclosed invention may be powered by an ordinary hand-held drill motor, either AC or battery operated. While the primary use of the disclosed invention is removal of particulates from spas, a series of interchangeable wands permits the device to be used for cleaning other vessels such as aquariums.

BACKGROUND OF THE INVENTION

Ponds, pools, spas (or the more modern term "hot tubs") and aquariums have been in use for millennia. From the earliest recorded history to the present, humans have enjoyed the presence of water and the environments that are associated with water. Vessels of varying size from very small to very large have been used for a wide range of aesthetic and utilitarian purposes.

One problem has plagued vessels of all sizes: keeping particulates out of the water contained. The problem is worse for outdoor, unprotected vessels such as pools or hot tubs, but even indoor installations such as aquariums or fountains suffer from particulate contamination. Keeping these particulates out of the vessel is an ongoing and difficult proposition.

Contemporary solutions for cleaning some of the vessel types exist. For example, there are numerous examples of pool cleaners; some are automatic and some are manual, but all work on generally the same principle. Regardless of the exact implementation, all share a common need for connection to some source of motive power and each contains a filter/trap combination to capture the particulates. Solutions for other vessel types exist as well, for example spa cleaners. These also require some source of motive power and use the filter/trap cleaning methodology.

Aquariums present a special case since the gravel that lines the bottom of many aquariums appear as particulate matter to many vacuum type cleaning systems. The problem is compounded by restricted space and the presence of aquatic species. Existing methods include pump and filter mechanisms and others, but are useful only for aquariums and the walls forming the vessel.

What would be desirable would be a method and apparatus that was adaptable to all vessel types. Further, it would be desirable that the device be portable, contain its own source of power, and be easy to use and to configure. The present invention provides these and other advantages as discussed in detail below.

SUMMARY OF THE INVENTION

The present invention describes an apparatus and teaches a method for removing particulate matter from a plurality of vessels. Examples of these vessels include aquariums, spas, fountains and pools. An ordinary hand held power drill motor is connected via a drill motor pump to a pick-up head containing a pair of hoses. Upon activation, a first hose applies suction to the pick-up head drawing both water and particulate into a chamber. The water continues through to a pump mounted in a housing, through the pump and out the discharge hose while the particulate is trapped within the chamber by a filter for later removal.

The apparatus of the present invention is comprised of a commonly available hand held electric drill motor, a pump housing unit containing a pump connected to the drill motor by a flexible drive shaft, and a plurality of different interchangeable wand units. Both battery operated and AC connected hand drills may be used. The chuck of the drill motor is connected to the flexible drive shaft in the customary manner. The flexible drive shaft is in turn connected to the load shaft of the pump by means of a collar and set screw.

Various special purpose wands may be attached to the control unit. Each of the wands contains a multi-chambered pick-up head and an extension. The length of the extension is dependent upon the purpose of the wand. By way of example, but not meant as a limitation, a relatively short extension of 12 inches may be used to clean the particulate from a fountain or aquarium while a 36 inch extension may be used to clean the particulate from the bottom of a spa.

The pick-up head is comprised of two chambers: a removable lower chamber and an upper fixed chamber. The lower removable chamber has an inlet valve that operates in a manner that allows particulate matter to be sucked in through an opening in one end of the lower chamber when suction is applied at the opposite end of the lower chamber. When suction is not present the valve closes, trapping the particulate within the lower chamber.

The upper fixed chamber is comprised of two sub-chambers separated by a baffle. The input sub-chamber has a filter at one end and a suction port disposed on the baffle at the opposite end. A suction hose completely fills the suction port such that under suction conditions water is drawn into the lower sub-chamber via the filter and into the suction hose. The upper sub-chamber is comprised of the opposite side of the baffle on one end and two hose ports on the opposite end. One hose port is used as a suction hose, with the hose transiting the upper sub-baffle and entering the suction port on the baffle. The other hose port is used to accommodate the discharge hose. The upper sub-chamber also has a discharge port disposed on the circumference of the upper sub-chamber wall above the baffle.

In operation the method of the present invention applies suction to the suction hose when the user activates the trigger mechanism of the drill motor. The source of the suction is the pump contained within the housing. The suction causes the inlet valve on one end of the lower sub-chamber to open allowing water to be drawn into the lower sub-chamber of the pick-up head. Any particulate matter proximate to the pick-up head will be pulled into the lower sub-chamber and will attempt to enter the suction hose. However, the filter attached to one end of the upper sub-chamber will allow water to pass but will block the particulate matter, thereby trapping the particulate matter inside the lower sub-chamber.

The water drawn in through the inlet valve transits the suction hose to the inlet side of the pump contained within the pump housing unit. The pump operates in the conventional manner causing the water to be discharged on the outlet side of the pump. A discharge hose carries the water from the outlet side of the pump to the upper sub-chamber of the pick-up head. Once the water enters the upper sub-chamber it exits via the discharge port disposed on the wall of the upper sub-chamber.

The method and apparatus of the present invention offer several advantages over the prior art. Among these are multiple uses, ease of operation and portability. As well as these advantages, the present invention has other advantages discussed in detail below in conjunction with the drawings and figures attached.

DETAILED DESCRIPTION OF PREFERRED EMBODIMENTS

Figure 1:
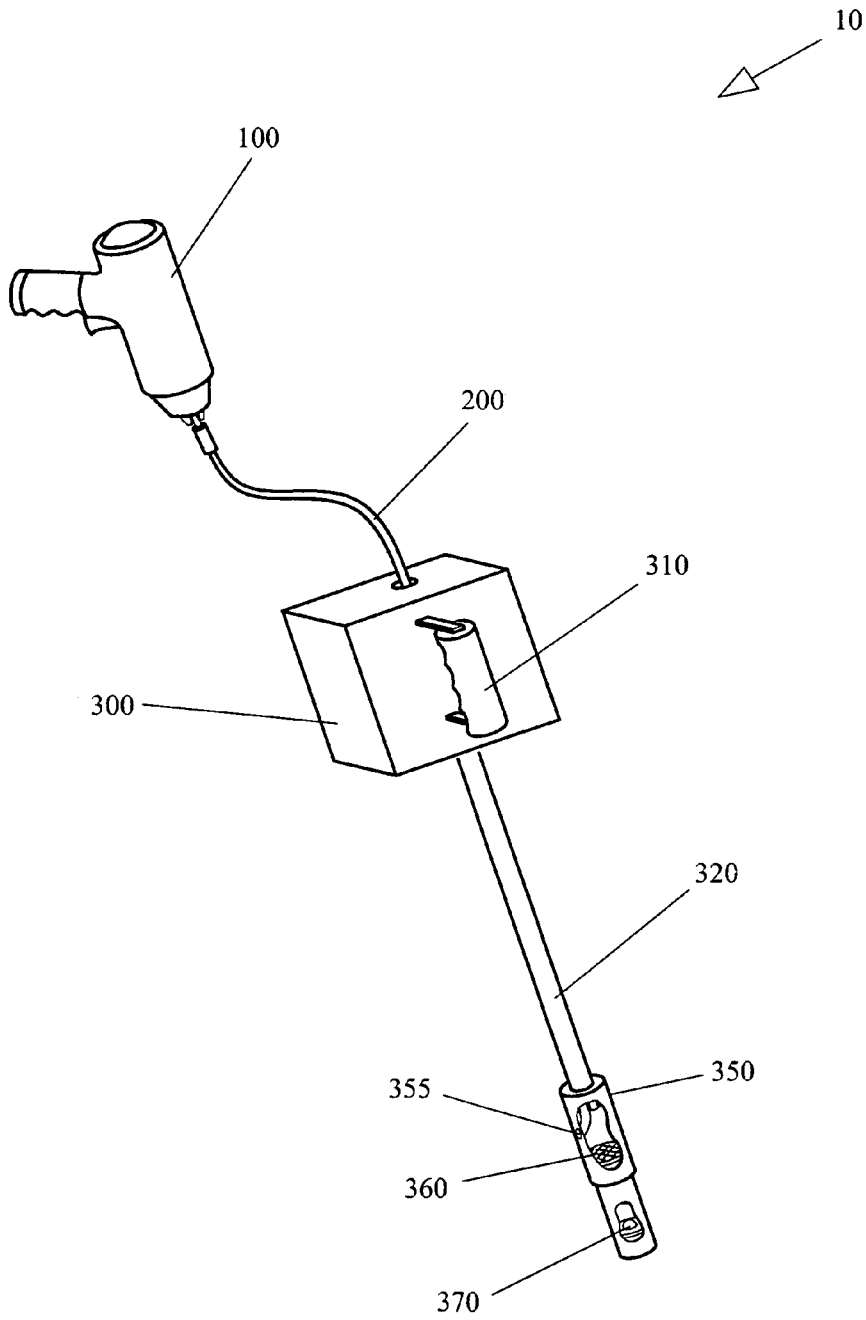
FIG. 1: is a view of one embodiment of the present invention configured for use in cleaning particulates from a spa.

As described briefly above, the apparatus of the present invention is comprised of a common drill motor, a pump housing unit and a pick-up head connected to the pump housing unit by a wand of varying length. FIG. 1 shows one embodiment 10 of the apparatus suited for cleaning spas. As can be seen, the drill motor 100 is connected to the pump housing unit 300 via a flexible drive shaft 200. The pick-up head 350 connects to the pump housing unit 300 by means of a wand 320.

Pump housing unit 300 is further equipped with a handle 310. Handle 310 allows the user to grasp the pump housing unit 300 in one hand while operating the drill motor 100 with the other. The handle 310 provides the user with the ability to direct the pick-up head 350 in any desired direction to capture particulate matter.

Pump housing unit 300 connects to pick-up head 350 via wand assembly 320. A pair of hoses (not shown) are routed within wand assembly 320. One of the hoses is an inlet hose and the other an outlet hose. The wand assembly 320 and pick-up head 350 combine to form special purpose attachments for accomplishing a plurality of tasks. For example, but not in the way of limitation, one hose/pick-up head assembly may be attached to the pump housing unit 300 to be used for cleaning particulates from a fountain while another hose/pick-up head assembly may be used to clean a spa. The hose/pick-up head assembly attaches to pump housing unit 300 using a "quick connect" type connector of the customary type known in the art. For example, in one embodiment, the quick connectors used are FFC35 series from Colder Products Company, St. Paul, Minn. Note that these connectors are not shown since they have no direct bearing on the invention, however it will be understood that the lack of a detailed description is not to be read as a limitation on the invention.

As detailed further below, pick-up head 350 is comprised of a number of components including upper and lower chambers, inlet valve 370, filter 360 and discharge hole 355. Each of these will be described in conjunction with FIG. 2 below. However, by way of a general description, the lower chamber of the pick-up head 350 is detachable allowing the user to change filter screen sizes and to remove any collected particulates.

Figure 2:
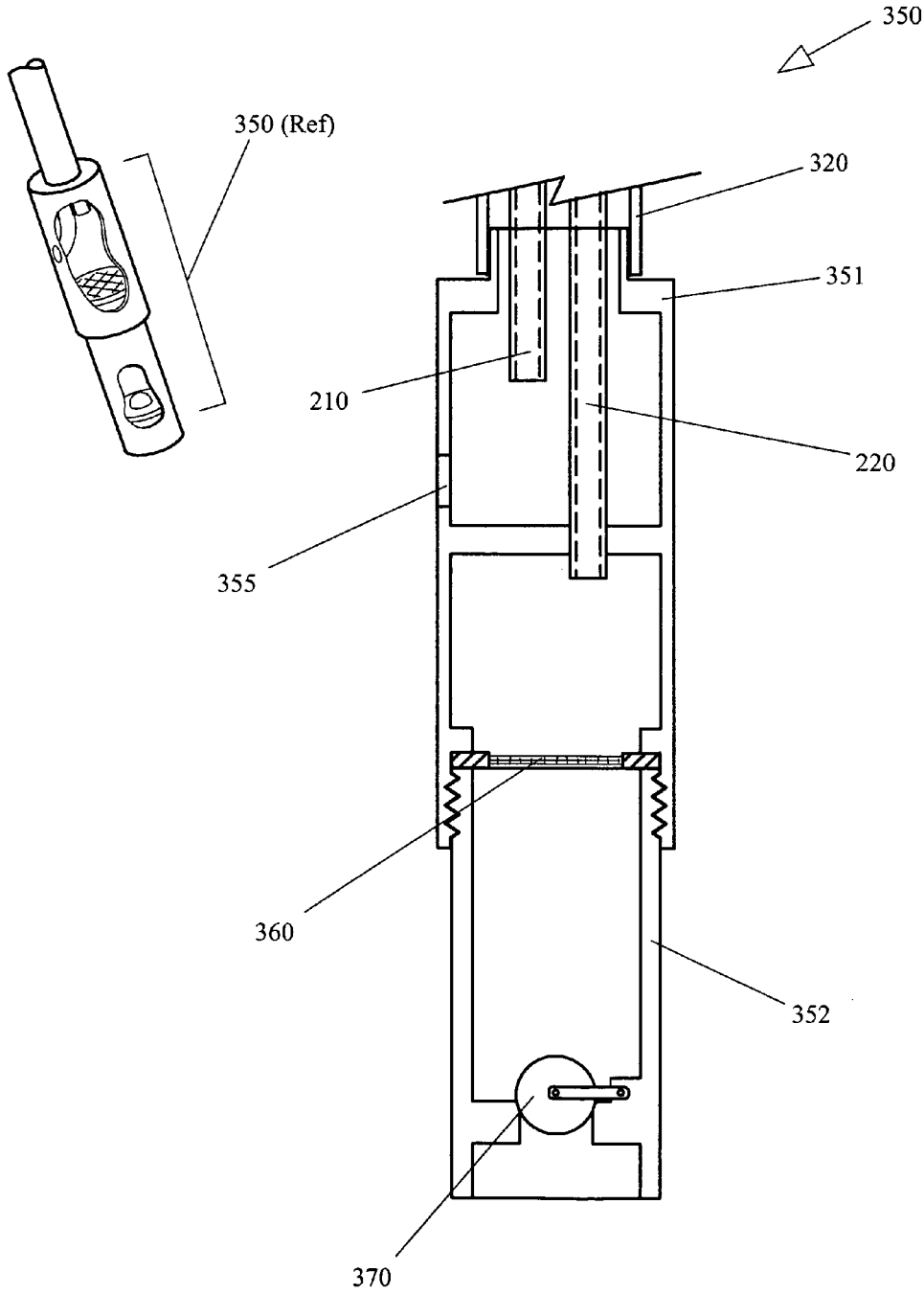
FIG. 2: provides details of the pick-up head and particulate matter trap mechanism of the present invention.

Looking at FIG. 2 the pick-up head 350 is shown in greater detail. Pick-up head 350 is comprised of two main sections: lower chamber 352 and upper chamber 351. Lower chamber 352 mates with the upper chamber 351 by a thread mechanism. Inlet valve 370 is hinged at the inlet end of the lower chamber and is the particulate trap. As described below, under the influence of the pump, the inlet valve 370 opens and allows water containing particulate matter to enter the lower chamber 352. When the pump is not operating the inlet valve closes trapping the particulate inside the lower chamber 352.

Upper chamber 351 is divided into two sub-chambers by a central baffle. The lower of the two sub-chambers, referred to as the inlet sub-chamber, mates via a threaded mechanism to lower chamber 352. At the input end of the inlet sub-chamber a particulate filter 360 is affixed in such a way that when the lower chamber 352 is separated from the upper chamber 351 by unscrewing the threaded mechanism the particulate filter screen 360 remains in place. This enables any trapped particulate matter to be emptied from the lower chamber 352. One benefit of the present invention is that the coarseness of the filter screen 360 may be changed to adapt to different tasks.

The central baffle has a single hole in it through which is disposed a suction hose 220. The hole and suction hose 220 are dimensioned relative to each other in a way that causes a seal to be formed between the inlet sub-chamber and the discharge sub-chamber above it. Suction hose 220 is connected to the inlet side of the pump located in the pump housing unit 300 described briefly above and in detail in conjunction with FIG. 3 below. Also contained in the discharge sub-chamber is a discharge hole 355 located at a position on the outer circumference of upper chamber 351 and above the central baffle. Water emerging from the discharge side of the pump located in the pump housing unit 300 is transferred via discharge hose 210 and forced to exit the pick-up head via discharge hole 355. In this way a complete path for incoming and outgoing water is provided, thus one advantage of the present invention is that no water is consumed from the vessel being cleaned, alleviating the need for replacing conditioned water in the vessel. Pick-up head 350 is sealably connected to wand 320 in such a way as to relieve any strain on suction and discharge hoses 220 and 210 respectively.

Figure 3:
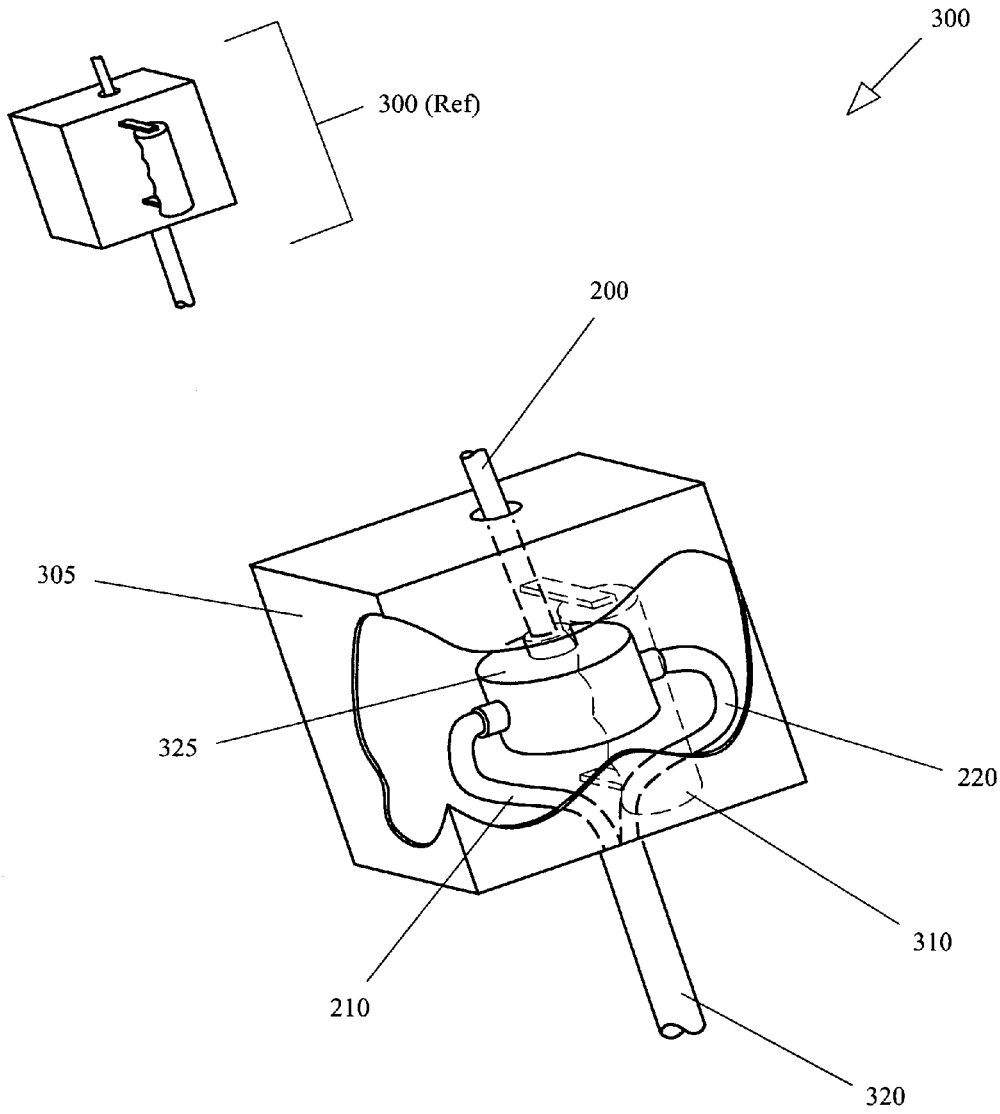
FIG. 3: provides the details of the hand held pump housing unit of the present invention.

FIG. 3 provides the detail of pump housing unit 300. Pump housing unit 300 is comprised of a case 305 containing pump 325, a handle 310 (shown as a dashed line for clarity,) and the necessary hoses and connectors to mate with the wand 320 and flexible drive shaft 200. The flexible drive shaft 200 is connected to pump 325 in such a way that when the trigger of the drill motor 100 is depressed by a user, the shaft of the pump 325 turns. In an exemplary embodiment, flexible drive shaft 200 is a 17106 from Vermont American, Mount Prospect, Ill. and the pump is a Jabsco 17250-003 from ITT Industries, White Plains, N.Y. Other drill motor pumps from other manufacturers could be used without departing from the spirit of the invention, thus the use of this particular drill pump should not be read as a limitation on the scope of the invention. Suction hose 220 and discharge hose 210 connect to the pump 325 in the customary manner.

Handle 310 is constructed so that a user can grip pump housing unit 300 in one hand and operate the trigger of the drill motor 100 using the other hand. The drill motor 100 may be of the battery operated or AC operated type. In an exemplary embodiment, the drill motor 100 is a ⅜ inch variable speed 7144 Type I from Black & Decker Inc., Raleigh, N.C., however, as will be recognized, any drill motor may be used without departing from the spirit of the invention.

As shown in this exemplary embodiment of the present invention, pump housing 305 is a simple aluminum box. However, it will be recognized that the pump housing 305 could be made in any shape and from any material without departing from the spirit of the invention. Thus, for example, the pump housing 305 could be made from plastic and be of the clamshell type. Further, handle 310 could be an integral part of the pump housing 305, thus it is not necessary that the handle be a separate part as shown.

Operation of the present invention is discussed in conjunction with FIGS. 4 and 5 below. It will be understood that the drill motor 100 discussed in detail above is connected to the pump 325 via the flexible drive shaft 200, and that the pick-up head 350 is connected to pump 325 inlet and outlet via hoses 220 and 210 respectively and each of the several components are operating properly. That is, when a user depresses the trigger on the drill motor 100 the pump 325 operates due to rotation of the drill motor chuck causing a suction to be created at the input to the pick-up head 350.

Figure 4:
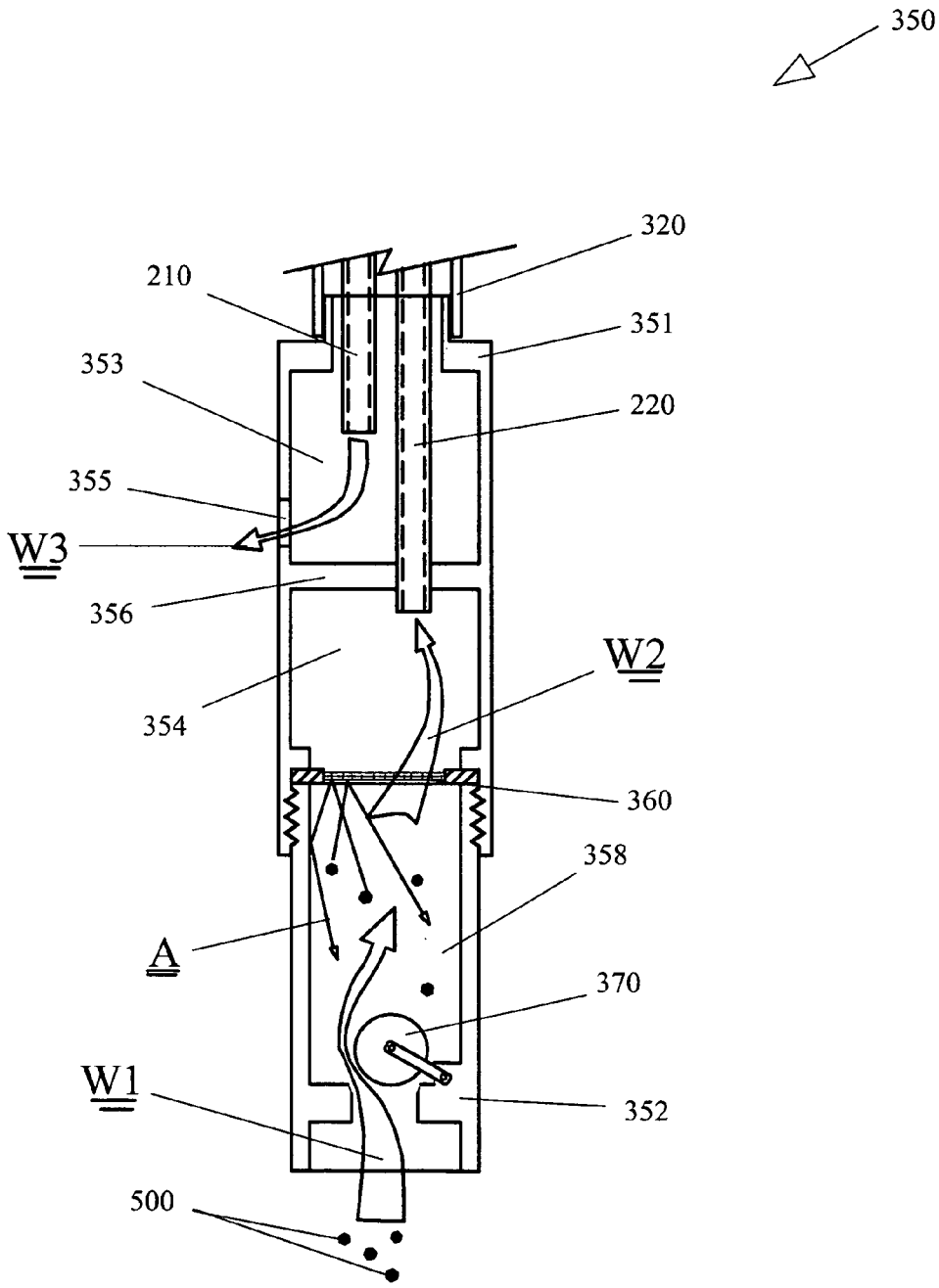
FIG. 4: shows the detail of the pick-up head during cleaning operation of the present invention.

Supposing that a user wishes to remove particulate matter form the bottom of a spa, the pick-up 350 head of FIG. 4 is attached to a wand 320 (partially shown) and is immersed in the spa in close proximity to the particulate to be removed. The user depresses the trigger of the drill motor 100 which causes the pump (325 of FIG. 3) to operate due to rotation of the drill motor chuck which is transferred to the pump shaft via flexible drive shaft 200 of FIG. 1. Suction is created in suction hose 220 which creates a low pressure area in the lower cavity 354 of the upper chamber 351. Since filter 360 is transparent to this low pressure, it is felt on the top of inlet valve 370, which opens in response. A water flow W1 enters cavity 358 in the lower chamber 352 and, as a direct effect, the particulate matter 500 is pulled along into lower chamber cavity 358.

Water flow W2 passes through filter 360, enters suction hose 220, passes through the pump 325 in the pump housing unit (300 of FIG. 3) and returns to the upper cavity 353 of the upper chamber 351 via discharge hose 210. Baffle 356 acts as a barrier to the discharge water flow W3, forcing it to exit the cavity 353 via discharge hole 355, returning the now cleaned water to the vessel it was initially removed from. However, while the filter 360 is permeable to water, it will not allow particulate A to pass. Instead, it is reflected off of the lower surface of filter 360 and becomes trapped inside cavity 358 of the lower chamber 352.

As long as the trigger of drill motor 100 is depressed there will exist a water flow W2 into the pump 325 and a discharge flow W3 out of the pump 325 in the pump housing unit 300. In turn a water flow W1 will exist at the inlet valve 370. Any particulate matter that attempts to exit cavity 358 will encounter the incoming water flow W1 and again be carried toward the filter 360. Any particulate matter in close proximity to the input of the pick-up head 350 will thus be swept into the cavity 358 and remain there as long as water flow W1 exists. At the moment the trigger of drill motor 100 is released, inlet valve 370 closes due to lack of water flow W1. All particulate matter that has been swept into cavity 358 of lower chamber 352 is thus trapped. It cannot permeate the filter 360 and it cannot escape past closed inlet valve 370.

Figure 5:
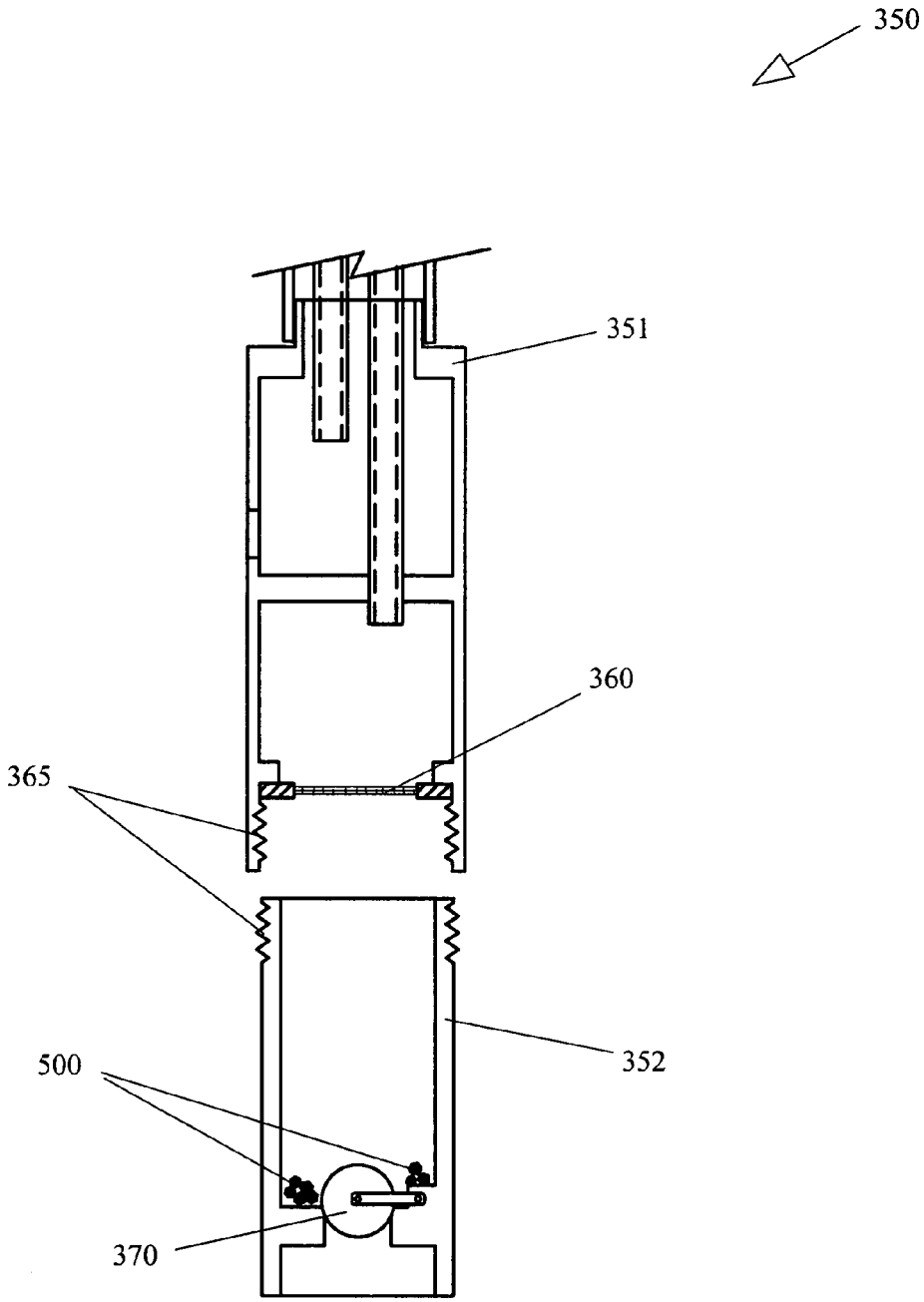
FIG. 5: shows the removal of the lower sub-chamber of the present invention with particulate trapped after a typical cleaning operation.

Looking now at FIG. 5, a view of the pick-up head 350 with the lower chamber 352 and the upper chamber 351 separated is shown. The user has released the trigger of the drill motor 100 causing the inlet valve 370 to drop to the closed position. Particulate matter 500 has dropped to the bottom of lower chamber 352 since no upward water flow, such as water flow W1 in FIG. 4, is present to keep the particulate matter 500 suspended in the incoming water stream. After removing the pick-up head from the vessel being cleaned, the user unscrews the lower chamber 352 from the upper chamber 351 using threaded interface 365. Filter 360 remains in place in the upper chamber 351 because the filter has an interference fit with the inner diameter of the upper chamber 351. In a preferred embodiment the interference fit is formed through the use of a rubber seal, but other interference fits could be used thus the use of the rubber seal should not be read as a limitation on the scope of the invention. Once the lower chamber 352 has been separated from the upper chamber 351 the user may easily remove the particulate matter by dumping and/or rinsing.

One advantage of the present invention is that the filter may be easily removed for cleaning or for changing to a different size as might be required to pick up smaller (or larger) particulate matter. When used in combination with different special purpose wand/pick-up head combinations, the apparatus of the present invention is capable of being used for a plurality of different cleaning problems. By way of example, but not as a limitation, a smaller filter grid might be used in conjunction with a short wand/pick-up head to clean relatively small particulates from the sides or bottom of an aquarium. In the same way, a larger filter grid with a medium sized wand/pick-up head might be used to clean a fountain or small pool.

A second advantage of the present invention is that no water is consumed from the vessel being cleaned, alleviating the need for replacing conditioned water in the vessel. This is crucial for such situations as saltwater aquariums or spas that require balanced pH. While some prior art devices use a suction cleaning method, they deposit the water in the suction hose to the ground or surroundings. This necessarily means that new water must be added to replace that which was lost. Since the new water is very likely not pH balanced, the chemical balancing operation will have to be completed.

A third advantage of the present invention is the use of commercially available common drill motors for motive power. Virtually any drill motor may be used as long as the chuck mechanism may be properly connected to the flexible drive shaft. This allows a user to use existing equipment to accomplish a variety of cleaning tasks by simply changing the filter screen and/or wand length.

A fourth advantage of the present invention is that the pump is located in the control unit. Thus simply by changing the wand/pick-up head combination, different tasks may be accomplished using a single control unit. In this way the user achieves a gain in both economic and utilitarian terms.

A fifth advantage of the present invention is the elimination of the need to waterproof the control mechanism. Since the pump is contained within the hand held pump housing unit, no liquid from the vessel to be cleaned gets onto the control unit.

I claim:

1. An apparatus for removing particulate matter contained in a liquid stream from a plurality of vessels, comprising:

a hand held drill motor;

a flexible drive shaft;

a pump housing unit having a handle and containing a drill motor operated pump, said drill motor operated pump connected to said hand held drill motor by said flexible drive shaft such that when said hand held drill motor is activated said drill motor operated pump operates;

a wand assembly, said wand assembly further comprised of;

a wand shaft, wherein one end of said wand shaft is fixably attached to said pump housing unit;

a pick-up head, said pick-up head attached to the opposite end of said wand shaft, said pick-up head further containing an inlet chamber, an outlet chamber, and inlet valve and a filter, and;

a suction hose and a discharge hose routed within said wand shaft, wherein a first end of said suction hose is connected to the inlet side of said drill motor operated pump and a second end of said suction hose is connected to said inlet chamber of said pick-up head, and wherein a first end of said discharge hose is connected to the outlet side of said drill motor operated pump and a second end of said discharge hose is connected to said outlet chamber of said pick-up head.

2. The pump housing unit of claim 1 wherein the housing of said control unit is made of plastic.

3. The pump housing unit of claim 1 wherein the housing of said control unit is made of aluminum.

4. The wand assembly of claim 1 wherein the length of said wand is approximately twelve inches, said wand assembly suitable for cleaning shallow vessels.

5. The wand assembly of claim 1 wherein the length of said wand is approximately thirty-six inches, said wand assembly suitable for cleaning moderately deep vessels.

6. A method for removing particulate matter contained in a liquid stream from a plurality of vessels, comprising:

attaching a hand held drill motor to a pump housing unit by means of a flexible drive shaft, said pump housing unit having a handle and containing a drill motor operated pump, said drill motor operated pump connected to said hand held drill motor by said flexible drive shaft such that when said hand held drill motor is activated said drill motor operated pump operates;

connecting a wand assembly to said pump housing unit, said wand assembly further comprised of;

a wand shaft, wherein one end of said wand shaft is fixably attached to said pump housing unit;

a pick-up head, said pick-up head attached to the opposite end of said wand shaft, said pick-up head further containing an inlet chamber, an outlet chamber, and inlet valve and a filter, and;

a suction hose and a discharge hose routed within said wand shaft, wherein a first end of said suction hose is connected to the inlet side of said drill motor operated pump and a second end of said suction hose is connected to said inlet chamber of said pick-up head, and wherein a first end of said discharge hose is connected to the outlet side of said drill motor operated pump and a second end of said discharge hose is connected to said outlet chamber of said pick-up head;

immersing said pick-up head of said wand assembly into a vessel to be cleaned, placing said pick-up head in close proximity to particulate matter to be removed from said vessel;

activating said drill motor operated pump by depressing said trigger thereby causing said pump to operate creating a stream of liquid, said stream of liquid further causing a pressure differential to exist across said inlet valve of said pick-up head, said pressure differential causing said particulate matter proximate to said pick-up head to be sucked into said pick-up head;

separating said particulate matter from said stream of liquid within said pick-up head by a filter means;

deactivating said trigger causing said pressure differential to be lost further causing said inlet valve to close thereby trapping said particulate matter within said pick-up head;

removing said wand from said vessel;

detaching said pick-up head from said wand, and;

discarding said particulate trapped within said pick-up head.

* * * * *